US008464808B2

(12) United States Patent
Leü et al.

(10) Patent No.: US 8,464,808 B2
(45) Date of Patent: Jun. 18, 2013

(54) METHOD AND DEVICE FOR CONTROLLING A ROCK DRILL RIG

(75) Inventors: Marcus Leü, Fjugesta (SE); Magnus Olsson, Hallsberg (SE); Jonas Sinnerstad, Örebro (SE); Deyi Jiao, Plano, TX (US); Eugene Cheng, Plano, TX (US)

(73) Assignee: Atlas Copco Rock Drills AB, Orebro (SE)

( * ) Notice: Subject to any disclaimer, the term of this patent is extended or adjusted under 35 U.S.C. 154(b) by 643 days.

(21) Appl. No.: 12/452,224

(22) PCT Filed: Jun. 26, 2007

(86) PCT No.: PCT/US2007/014781

§ 371 (c)(1),
(2), (4) Date: Dec. 21, 2009

(87) PCT Pub. No.: WO2009/002306

PCT Pub. Date: Dec. 31, 2008

(65) Prior Publication Data

US 2010/0101862 A1 Apr. 29, 2010

(51) Int. Cl.
*E21B 7/02* (2006.01)

(52) U.S. Cl.
USPC ..... 175/24; 175/26

(58) Field of Classification Search
USPC ..... 175/24, 25, 26, 27
See application file for complete search history.

(56) References Cited

U.S. PATENT DOCUMENTS

| | | | | |
|---|---|---|---|---|
| 4,165,789 | A | 8/1979 | Rogers | |
| 4,354,233 | A | 10/1982 | Zhukovsky et al. | |
| 4,625,814 | A | 12/1986 | Helasuo et al. | |
| 5,129,464 | A | 7/1992 | Richier | |
| 6,308,790 | B1 | 10/2001 | Mensa-Wilmot et al. | |
| 6,749,029 | B2 | 6/2004 | Alft et al. | |
| 2005/0211468 | A1 | 9/2005 | Veeningen et al. | |
| 2007/0007039 | A1 | 1/2007 | Noel | |
| 2009/0038847 | A1 * | 2/2009 | Muona et al. | 175/26 |
| 2009/0250263 | A1 * | 10/2009 | Saha | 175/24 |

FOREIGN PATENT DOCUMENTS

| | | |
|---|---|---|
| JP | 63-315794 | 12/1988 |
| JP | 07-293185 | 11/1996 |
| SU | 647446 | 2/1979 |

* cited by examiner

*Primary Examiner* — William P Neuder
(74) *Attorney, Agent, or Firm* — Mark P. Stone

(57) ABSTRACT

A method and a device for controlling a drill rig (1) which includes a carrier vehicle with at least one feed-beam (3), wherein a drill machine (2) is movable to-and-fro, wherein rig parameters are set by a control unit (6) and wherein each one of a plurality of operating modes (M1-M6) includes specified operating settings for different operating parameters of the rig. Each operating mode (M1-M6) is selectable such that operation of the rig is related to a particular type of rock, in which drilling is to be performed, and each operating mode (M1-M6) includes operating settings that are adapted to the prevailing type of rock. The invention also concerns a drill rig.

19 Claims, 3 Drawing Sheets

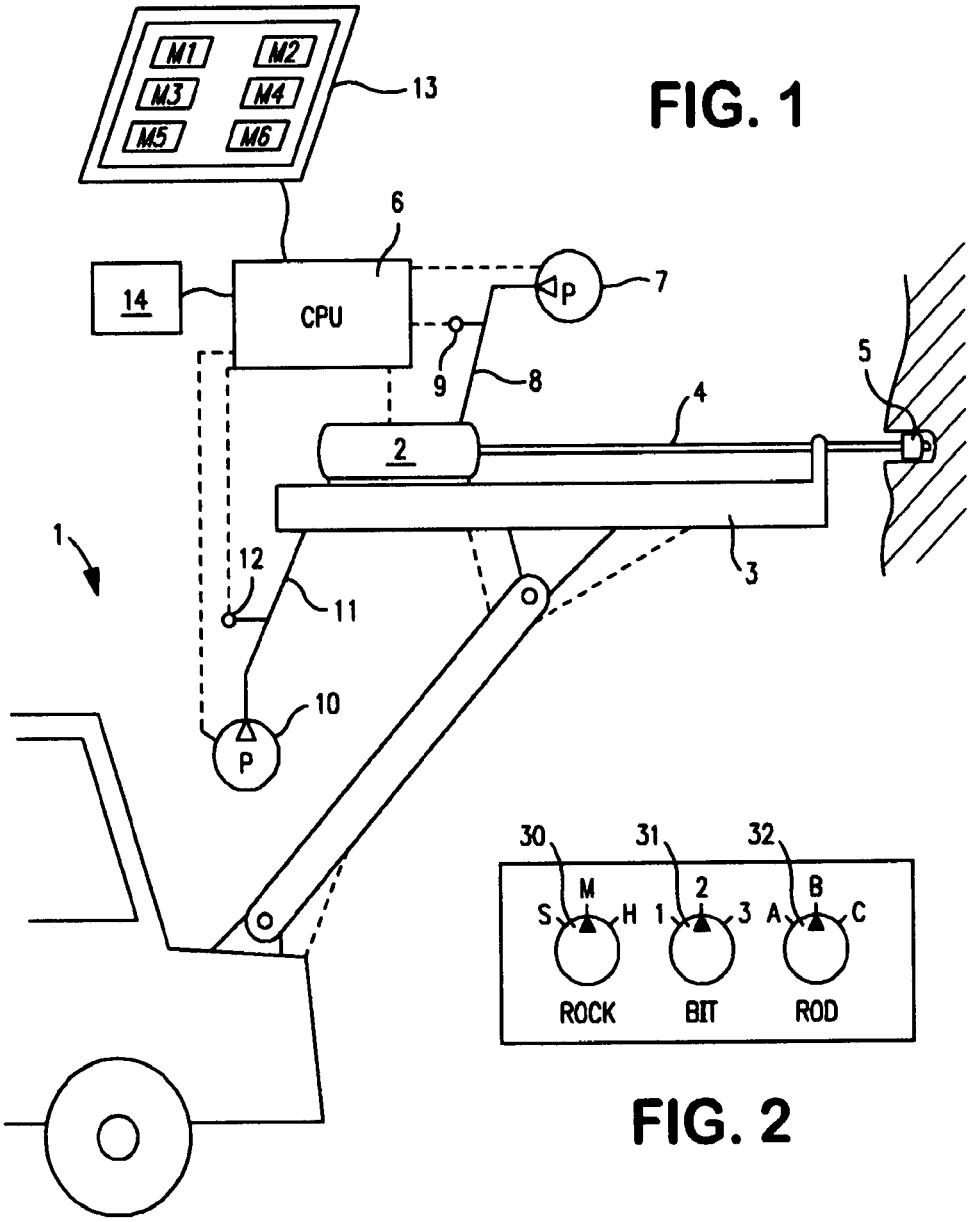
FIG. 1
FIG. 2
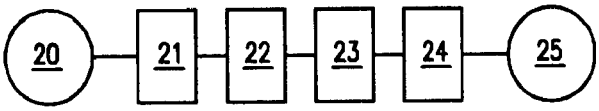
FIG. 3

METHOD AND DEVICE FOR CONTROLLING A ROCK DRILL RIG

FIELD OF THE INVENTION

The invention concerns a method and a device for controlling a rock drill rig which includes a carrier vehicle with at least one feed-beam, whereon a drilling machine is movable to and fro, wherein parameters for drill rig control are set by a control unit, and wherein each one of a plurality of operating modes includes specified operating settings for different operating parameters of the rig.

BACKGROUND OF THE INVENTION

When performing percussive rock drilling, a shock wave is generated by the percussive mechanism of the drilling machine. This shock wave is transmitted as an energy stress wave through the drill rod down to the drill bit. When the stress wave reaches the drill bit, its hard metal button elements are pushed against the rock with such a strong force that the rock is fractured. In order for the hard metal button elements to come into contact with unaffected rock after one strike, the drill rod is rotated by means of a rotator including a rotation motor (often hydraulically driven) and a transmission. Rock dust is continuously removed from the front side of the drill bit by flushing.

The drilling machine is mounted on a cradle, which is movable to and fro on ad feed-beam. The drilling machine and the slide are driven towards the rock along the feed-beam by means of a feed motor which can be a hydraulic cylinder or a chain feeder.

When a new drill rig is delivered to a buyer, it is set with basic settings with respect to the drilling or operating parameters of the drill rig. These parameters are i.a. pressure and hydraulic flow levels for the different components of the rig. Further, the characteristics for the operating functions of the rig which concerns how the rig will be controlled during or react to differently sensed operating conditions are set.

The basic setting of a new drill rig is normally tuned to the operating conditions that prevail in an intended area of use of the rig and possibly to the requirements of the user. If the drill rig is moved to another site with other drilling conditions or, more generally, during considerable variations of the conditions for drilling, the parameters should be adjusted to be set differently in order to adapt to these new conditions in order for the drilling to be as efficient as possible.

Adjustments of rig settings are normally carried out manually by a technician and in some cases by the rig operator, whereby a plurality of parameters affecting the percussive mechanism, the rotation motor, the feed motor etc, of the drilling machine are set.

Basic parameters that are difficult so set are:

Feed pressure; too high can result in deviating drilling direction—too low can result in wear, loosened drill string joints and ultimately drill string breakage.

Percussion pressure; too high can result in wear and breakage, increased reflexes through the drill string—too low results in reduced productivity.

Rotation speed; too high can result in wear and sometimes deviating drilling direction—too low results in wear and reduced productivity. Except for the basic parameters, there are a large number of drilling parameters that need to be set, such as, only as an example:

Feed speed and feed control levels, Too high can result in damaged equipment if the drill bit enters a cavity during drilling; Too low results in reduced productivity.

Damping pressure control levels; Too high levels will result in reduction productivity because the percussion pressure is reduced to collaring level too often; Too low will result in wear and breakage.

Flushing medium pressure; Too thigh will result in wear of the drill bit and high consumption of energy; Too low results in that the drill bit gets stuck.

A problem with manual setting of parameters is that it is very complex to correctly provide a modern drill rig with the accurate % parameter settings, since altering one parameter can affect the conditions for one or a plurality of other parameters. In particular, the feed force and the rotation torque need to be balanced to each other to sustain an efficient drilling operation. Lack of such balance because of altered rock formation conditions may more easily lead to jamming problems.

It can thus be very difficult even for a skilled technician or operator with great knowledge about the function of the system to obtain good results. Most often a trail and error method has to be performed, which can be very time-consuming.

A consequence of this is that there are often no new adjustments made at all or that the rig is set such that operation will not be as efficient as it could have been. This could lead to either increased wear and/or unnecessary ineffective operation.

As an example of the background art can be mentioned US2004/0140112 A1. This document describes an arrangement for controlling a rock drilling process, wherein a plurality of control modes can be chosen to control drilling from different criteria. As examples of control modes are mentioned: efficiency mode, quality mode, cost mode and optimizing mode.

The Aim and Most Important Features of the Invention

The aims of the present invention are to provide a method and a device wherein the draw-backs of the background art are at least reduced.

These aims are obtained in a method and a device as above, when each operating mode relates to a particular type of rock in which drilling is to be performed and that each operating mode is selectable in order to set operating settings that are adapted to the prevailing type of rock.

Hereby is achieved that the drill rig is guaranteed to be tuned and set in the direction of as much as possible, being optimized for operating in a particular type of rock. Hereby the operating parameters will be set in order to be adapted to the prevailing drilling situation.

As an example it could be mentioned that in rock of a certain hardness, where it is easy to get rock contact, it is possible to drill "aggressively", that is with greater feed force and percussion pressure, while in other types of rock, for example in softer rock, it can be necessary to have a more dynamic control with higher feed speed and feed speed control levels, but with lower feed force.

In each mode, the settings are also tuned to each other such that the settings co-act and do not counter-act each other, which could otherwise easily be the case with manually set systems. For example, a high percussion pressure together with low feed force could be harmful to the equipment in certain conditions. I.a. such unwanted combinations can be avoided through the invention.

Said operating parameters are preferably a plurality from the group: feed motor pressure, rotation motor pressure, control levels, rotation speed, percussion pressure, feed motor flow, rotation motor flow, flushing fluid flow, damping pressure control level, feed speed control levels.

It is preferred that activation of one control mode also sets the parameter values for, activates or de-activates different drilling control functions of the rig. Hereby said drilling control functions are one or more from the group:

Boost, which means that the percussion pressure is increased or "boosted" in the event that the drill bit meets harder rock. This is preferred in case drilling is performed in soft or medium hard rock, where the rock hardness can vary considerably.

Hole flushing. More intense flushing is called for in softer rock. Is regulated from position, air flow, number of cavities.

Damping control function, where feed pressure is regulated as a function of damping pressure. This function works well in hard rock but can be directly unsuitable in soft rock.

Boosted rotation, which can be useful in soft rock but unsuitable in hard rock because of increased bit wear.

Anti-jam function.

In the case of anti-jam function, the rotation pressure to the rotation motor as a rule will be increased when the drilling machine is on its way to get stuck, since a higher torque then is required in order to rotate the drill bit.

Should the rotation pressure continue to rise to a level corresponding to a "jamming limit", a function with anti-jamming protection could be started resulting in reverse feed of the drill slide. If the jamming will not cease within a set time, all drilling functions should be terminated.

Pressure control of feed—flow control of feed.

In an alternative drilling control function envisaged by the applicant, a combination of pressure and flow control of the feed flow to the feed motor is provided in order to provide a more gentle and more responsive control when the drilling machine is on its way to get jammed. This function could be initiated when the rotation pressure increases above a first level, which could be a set empirically determined value of the parameter indicating that the rotation torque and thereby the rotation resistance increases above values that can be considered to correspond to normal rock drilling. Since this reduces the feed flow will function be best suited for medium and soft rock.

Said operating modes are related to any from the group: soft rock, medium hard rock, hard rock. It can also be completed with further groups such as loose rock, abrasive rock, ore containing rock etc.

Through the invention, concerning different drill controlling functions for different modes, it could be prescribed: if the function is to be active, which of a plurality of function varieties that is or are to be active, which pressure and flow levels that are to be set for initiating control measures within the respective mode.

According to a preferred embodiment, one or more parameter from the group: bit size, rod size is selected. This can preferably be made manually. Hereby the system is easily adapted to drill process influencing equipment elements. Preferably one or more of the following varies as a function of bit size: flushing flow, rotation speed, feed pressure, percussion pressure, ratio feed force—rotation torque relation, starting point for initiating anti-jam function. Also preferably one or more of the following varies as a function of rod size: percussion pressure, feed motor pressure.

Skilled operators often have a feel for the performance of the drill rig which in certain aspects goes beyond what can be obtained by a control system. According to one aspect of the invention, it has been made possible to recommend adjustments of parameters within recommended ranges or from a set value.

Although there are often problems with manual adjustments, according to this aspect of the invention, it is advantageous to allow a certain freedom for skilled operators to fine tune how the rig is set. In particular it is advantageous when the system gives the opportunity for skilled operators to influence the setting of certain parameters within certain limits that can be predetermined. In one preferred embodiment, the system gives indications of recommended settings to the operator, whereby the operator has the opportunity to make certain adjustments to recommended settings, either so as to deviate with a determined maximum value from a recommended parameter value or to make adjustments within a recommended range. These recommendations are determined in an advantageous way, such that no parameters come in conflict with each other.

The corresponding advantages are obtained in a device according to the invention.

Further advantages and features of the invention will be explained in the following detailed description.

BRIEF DESCRIPTION OF DRAWINGS

The invention will now be described in more detail by way of embodiments and with reference to the drawings, wherein;

FIG. 1 diagrammatically shows a drill rig equipped with a device according to the invention with a control system, FIG. 2 diagrammatically shows an input device for a device according to the invention, FIG. 3 diagrammatically shows a method sequence in the form of a simple flow chart.

DETAILED DESCRIPTION OF EMBODIMENTS

Figure 4:
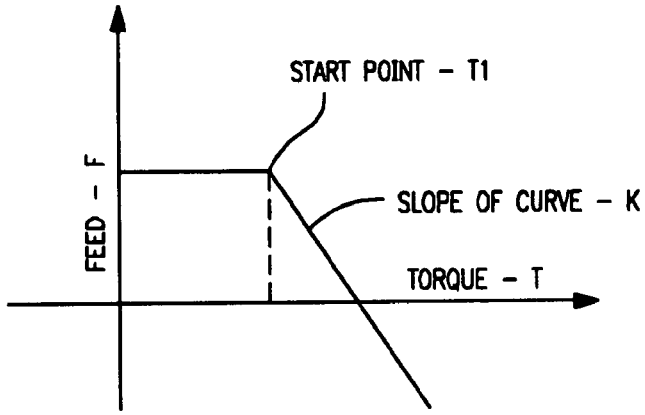
FIG. 4 shows a diagram of feed force as a function of torque.

In FIG. 1, reference numeral 1 indicates a drill rig for rock drilling, having an arm carrying a feed-beam 3. On the feed-beam 3 is, as conventionally, supported a to and fro movable rock drilling machine 2, which acts on a drill rod 4, which on its distal end is provided with a drill bit 5.

The rock drilling machine 2 includes in a manner known per se a rotation device (not shown) for rotating the drill rod 4 during drilling. A rotation motor is hydraulically driven by a rotation fluid flow emanating from the pump 7 over the conduit 8. The pressure in the conduit 8 is the rotation pressure which is sensed by a pressure sensor 9.

The rock drilling machine 2, is driven with a feed force F in its forward motion by a feed motor (not shown) being hydraulically driven by a feed flow which is generated by a pump 10 and transmitted over a feed conduit 11. The pressure in the feed conduit 11 is the feed pressure which is sensed by a pressure sensor 12. Reference numeral 6 indicates a central processing unit (CPU) which receives signal from the sensors 9 and 12 and thus monitors the pressures in these conduits. A percussion mechanism (not shown) inside the drilling machine housing is as usual driven by a percussion fluid flow having a percussion fluid pressure. The position and speed of the rock drill is determined with a length sensor (not shown) on the feed beam.

CPU 6 communicates, when it comes to control functions, with i.a. pumps 7 and 10 as well as with the rock drilling machine 2. The percussion fluid pressure is monitored and controlled by the CPU 6. Further, the CPU 6 has preferably other functions, which are not described here since they are not subject of the present invention. FIG. 1 shows an underground rig but the invention can also be applied to a surface operated rig.

13 indicates an input device in the form of a touch screen, which is intended to communicate with the CPU in order to choose a mode that is to be used. In the case of the shown touch screen, six modes M1-M6 are pre-programmed and represented with button fields on the touch screen. 14 indicates a memory which is connected to the CPU and which contains settings for the different modes. The memory can also be part of an internal memory in the CPU. Alternatively, values for a specific mode can be communicated to the rig over a LAN, over Internet or the like.

Also other methods for performing entering modes can be used such as a menu in the operator program of the rig; that the rig is remote controlled for automatic entering of a mode that is to be used for a particular operating site; or that the rig over the CPU is simply connected to a set of buttons, one or more adjustment knobs etc.

Not only rock conditions influence the operation of the drill rig. Different drill bits and different dill rods also have impact on different operating parameters. For that reason it is advantageous according to a preferred embodiment of the invention to have the possibility also to be able to input information into the CPU about the drill bit and the drill rod used during the drilling process.

In FIG. 2 is shown an input device having a mode selector 30 for selecting one of three rock conditions, namely soft (S), medium (M) or hard (H) rock.

The device in FIG. 2 further has means for entering bit size by means of a rotation selector 31 for choosing between a suitable number of, preferably, standard bit sizes. Here as an example three (1, 2 and 3) representing 115, 125 and 140 mm in bit diameter.

The device in FIG. 2 further has means for entering rod size. Reference numeral 32 indicates a rotation selector for selecting one of three (A, B and C) different rod sizes, here as an example representing 45, 51 and 60 mm in rod diameter.

By using a simple input device such as the one shown in FIG. 2 in connection with an electro-hydraulic system, these pre-defined parameters can be input into control modes in the controller system. This will simplify the system adjustment and tuning procedures.

The input device in FIG. 2 could be modified, for example such that selectors for rod and bit size are included on a touch screen similar to the one in FIG. 1.

In FIG. 3 is shown a method sequence in the form of a flow chart, wherein:

Position 20 indicates the start of the sequence.

Position 21 indicates choosing an operating mode related to the particular type of rock wherein drilling is to be performed and entering rod and bit size for the intended drilling procedure.

Position 22 indicates activating the chosen operating mode and thereby setting operating parameters which are stored for the chosen operating mode.

Position 23 indicates setting and activating, respectively, of drilling control functions relating to the chosen operating mode.

Position 24 indicates operating the drill rig according to the activated operating mode.

Position 25 indicates the end of the sequence.

The means related to the device according to the invention which executes the activated functions according to the invention are per se conventional control devices:

The means for controlling the percussive mechanism can include a sensor for sensing damping pressure or feed pressure and as a response thereto control the percussion pressure and/or the stroke length of the percussive piston.

The means for monitoring a parameter which is related to the rotation torque, for pressure or flow controlling the feed force as a response to variations of the value for that parameter is suitably on the one hand realized as software in the CPU in combination with per se known pressure control means, on the other hand realized as software in the CPU in combination with per se known fluid control means.

The means for reducing and increasing, respectively, the feed force by altering a feed flow to a fluid motor means performing the feed in relation to a change of the parameter value is suitably realized as software in the CPU in combination with per se known fluid control means.

The means for initiating an anti-jamming function with pre-set drilling machine parameters is suitably realized through the software in the CPU in combination with per se known mechanical setting means.

For flow control can suitably be used a pressure compensated valve, which means that a pressure difference over the inside and the outside of a main valve for feed shall be kept as constant as possible.

For pressure control can also be used an electronically controlled pressure limiter. When the pressure exceeds a certain level it is opened to tank and the pressure is reduced in the conduit. A controlled hydraulic pump can also be used.

Existing drilling controls on the market often have non-adjustable pre-set condition value or uses trial-and-error methods on site to determine the control parameters to achieve best results for anti-jam, drilling power regulation and system energy level adjustments. This procedure requires experienced operating personnel to perform the adjustment and set-up. It is being recognized impractical if this procedure should need to be performed regularly at the drilling site with different rock formations. As is indicated above, in practice such systems have been left un-tuned because of the difficulties associated with performing the setting procedures.

The anti-jam mechanism in respect of percussion drilling is based on the principle that the rotation torque level regulates the feed force level (or thrust force) in order to prevent the drill string from jamming. This is based on the theory that the torque level is proportional to the feed force supplied to the drill string. When too much feed force is applied at certain rock conditions, the torque level will elevated too high and beyond the capabilities of the rock drill rotation motor. Jamming conditions will then appear.

If the parameters in the anti-jam mechanism are pre-defined in such a way that virtually any drill operator easily can adjust the system in the direction of its optimum when the feed force is set by the system much could be gained. Hereby is achieved that the anti-jam process is as efficient as possible at any time in order to achieve smooth drilling and best use of energy.

Figure 5:
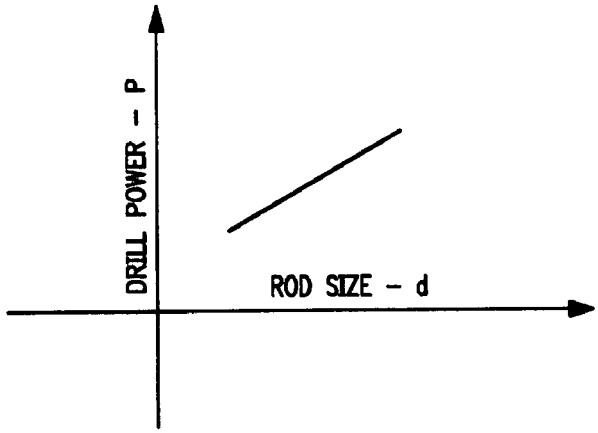
FIG. 5 shows a diagram of maximum percussion power level as a function of drill rod size.

In FIG. 4, feed force is represented as a function of torque level starting from T1: F−k(T−T1). If we use D to represent bit size and H to represent rock hardness, T1 in the above equation is defined as a function of both bit size D and rock hardness H. The slope k of the curve is also a function of bit size D and rock hardness H. These can be represented as:

$$T1=f_1(D,H)$$

$$k=f_2(D,H)$$

the maximum percussion power level is directly related to drill rod size, applied feed force, stress level limitations of material used in drill rods and couplings to connect the rods. If P represents drill power and d represents rod size, the relation can also be described as follows:

$P=f_3(d,F)$; This is represented in FIG. 5;

where in above equations:
F=drilling feed force
T=drilling rotation torque
H=rock hardness condition
D=drill bit size
P=drill percussion power level
d=drill rod size
k=ratio in torque-feed relation The exact relation between the variables in the above equations is defined by material strength, maximum stress level and empirical data from test field. As most, only three parameters in the above equations would need to be entered into the system so as to be pre-defined: rock condition, drill bit size and drill rod size, whereof the two last mentioned parameters are easily determined.

The bit size is selected so that one or more of following varies as a function of bit size: flushing flow, rotation speed, feed pressure, percussion pressure, ratio feed force-rotation torque relation, starting point for initiating anti-jam function.

The rod size is selected so that one or more of the following varies as a function of the rod size: percussion pressure, feed motor pressure.

In order to evaluate which type of rock that the drilling is to be performed in and thus which mode that should be used at the site, the basis for that evaluation can be examinations of the rock, the mountain, empirically obtained values during test drillings etc.

Figure 6:
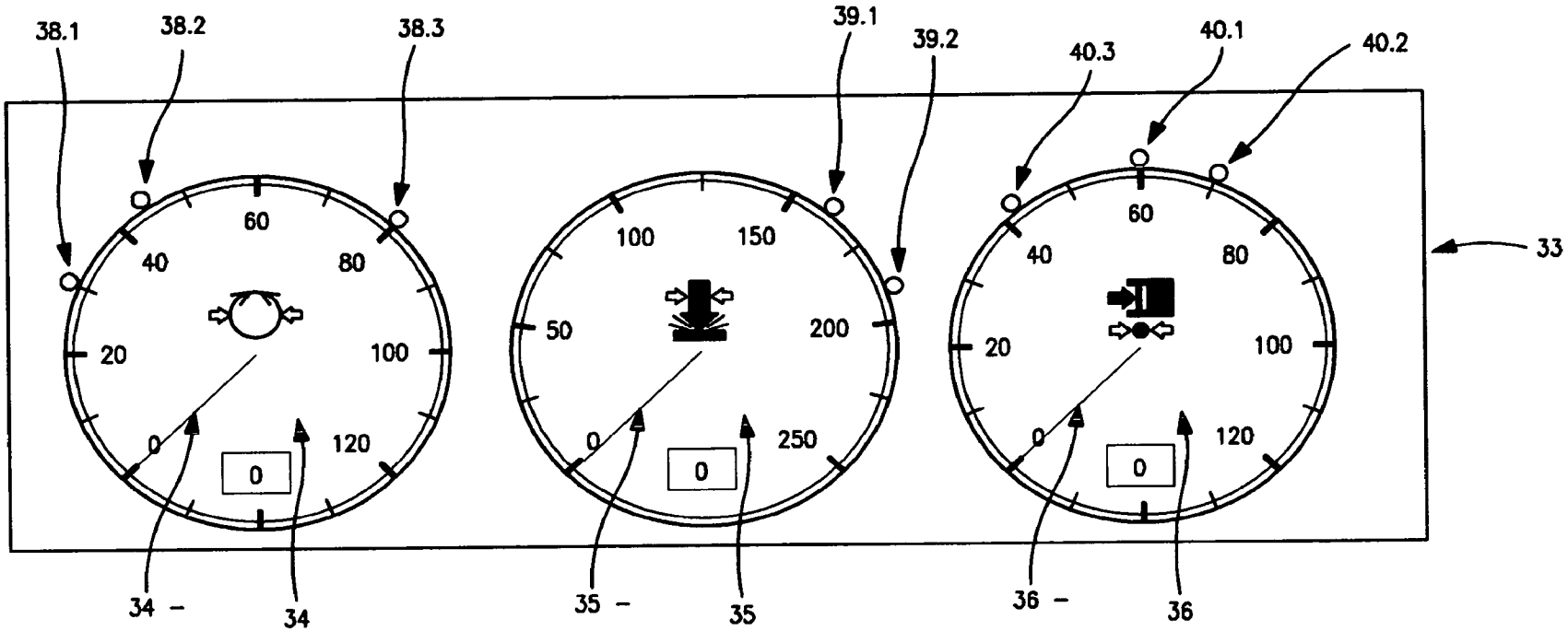
FIG. 6 shows an alternative input device for a device according to the invention.

In FIG. 6 is shown a display and input arrangement for representing different parameter values and for allowing manual adjustments. With this arrangement, skilled operators are given the opportunity to influence the settings of certain chosen parameters within certain limits. Alternatively the input means for operator input to the system can be an override device which allows the operator, preferably within ranges, to amend a parameter value selected by the system.

In this embodiment, the system gives indications of recommended settings to the operator within recommended parameter ranges, whereby the operator is recommended to make adjustments within these ranges.

In particular, FIG. 6 shows a display screen layout 33 having three parameter instruments: a rotation pressure instrument 34, a percussion pressure instrument 35 and a damping pressure instrument 36.

The damping-pressure instrument 36 can be exchanged for a feed (motor) pressure instrument 36. In that case, recommended range values for feed pressure can be provided. Like what is described above, the operator can undertake adjustments of the feed pressure settings according to the recommendations.

34', 35' and 36' indicate pointers for the respective instrument. The rotation pressure instrument 34 is used solely for display of prevailing rotation pressure. As a contrast, each one of the instruments 35 and 36, in a semi manual mode, shows indications of recommended ranges, inside which, an operator is recommended to make adjustments.

For instrument 34, indicators 38.1, 38.2 and 38.3 are control level indicators indicating levels where different functions become active.

For instrument 35 showing the percussion pressure, the recommended range is indicated by a minimum limit indicator being indicated with 39.1 and a maximum limit indicator with 39.2. For softer rock conditions, less impact power is needed which results in a lower recommended pressure range. When the rock conditions change to medium hard rock, percussion pressure needed for penetration is higher and therefore the recommended range is higher. Similar relationship applies for change from medium to hard rock. Normally the percussion pressure is set by the system, when the mode is changed, the pressure level is normally set in the middle of the recommended range, but can also be in other parts of the recommended range.

The damping pressure is the result of feed pressure and rock hardness. Softer rock usually gives a lower damping pressure than harder rock with the same feed pressure. By increasing feed pressure, the damping pressure will increase. To achieve a good balance between feed force and percussion pressure, the recommended damping pressure range for the selected mode is shown in instrument 36, where a minimum limit indicator is indicated with 40.1, a maximum limit indicator with 40.2. 40.3 indicates a control level indicator corresponding to indicators 38.1, 38.2, 38.3 on instrument 34.

For the instruments 35 and 36, ranges between the respective minimum limit indicator and maximum limit indicator are ranges, within which the operator is recommended to make adjustments.

Input to the system can be made by a mouse-controlled cursor (not shown) pointing on up and down turned arrows adjacent to each instrument (not shown). Input could also be by pressing buttons on a separate keyboard (not shown). The screen can also be a touch screen for direct input of data. In particular, an input desired value is preferably indicated with a specific marker, e.g. similar to the indicators, in respect of a each instrument.

The display screen layout in FIG. 6 could also indicate other parameter values in different fields (not shown here). These parameters are not subject to being influenced by the operator in this embodiment. A screen with the layout 33 can be the same as screen 33 in FIG. 1 or be in parallel with such a screen.

Differently skilled operators can have different access levels and be given different authorities to make adjustments for different parameters and/or for different ranges of parameters.

The invention can be modified within the scope of the claims and deviations from the above described embodiment can exist.

It is possible to have a simple system solely making use of the anti-jam function described above. In some cases it might be unnecessary to have means for entering bit size and or rod size into the system, for example if it is determined that the rig is to be operated in narrow-defined fields of use.

AS is indicated above, parameters could also be entered into the system over a LAN or in any other suitable manner.

The invention claimed is:

1. Method for controlling a drill rig which includes a carrier vehicle with at least one feed beam, whereon a drill machine is movable to-and-fro, wherein rig parameters are set by a control unit and wherein each one of a plurality of operating modes includes specified operating settings for different operating parameters of the rig, wherein each operating mode is selectable such that operation of the rig is related to a particular type of rock, in which drilling is to be performed, wherein each operating mode includes operating settings that are adapted to the prevailing type of rock, wherein rock condition is selected, whereby one or more of the following parameters varies as a function of rock condition: feed pressure, percussion pressure, damping pressure, wherein bit size is selected, whereby one or more of the following parameters varies as a function of bit size: flushing flow, rotation speed, feed pressure, percussion pressure, ratio feed force-rotation torque relation, starting point for initiating anti-jam function, and wherein rod size is selected, whereby one or more of the following parameters varies as a function of rod size: percussion pressure, feed motor pressure, wherein activation of one operating mode also sets the parameter values for, activates or de-activates drilling control functions, being one or more from the group; boost, hole flushing, pressure control of feed, flow control of feed, anti-jam function, damping control function, super rotation, feed speed control of percussion pressure.

2. Method according to claim 1, wherein said operating parameters are a plurality from the group: feed motor pressure, rotation motor pressure, rotation speed, percussion pressure, percussion fluid flow, feed motor flow, rotation motor flow, flushing fluid flow, damping pressure control level.

3. Method according to claim 1, wherein said operating modes are related to any from the group: soft rock, medium hard rock, hard rock, loose rock, abrasive rock, ore containing rock.

4. Method according to claim 1, wherein one or more parameters from the group: bit size, rod size is selected.

5. Method according to claim 1, wherein said method includes inputting adjustments of operating parameter settings by an authorized operator.

6. Method according to claim 5, wherein adjustments are made within predetermined ranges.

7. Method according to claim 6, wherein indications of recommended settings within recommended parameter ranges are given to the operator.

8. Method according to claim 5, wherein indications of recommended settings within recommended parameter ranges are given to the operator.

9. Device for controlling a drill rig which includes a carrier vehicle with at least one feed-beam, whereon a drilling machine is movable to-and-fro, wherein a control unit is arranged for setting parameters for the rig, and wherein the device includes memory means for storing a plurality of operating modes, whereby each operating mode includes specified operating settings for different operating parameters of the rig, wherein each operating mode is selectable such that operation of the rig is related to a particular type of rock, in which drilling is to be performed, wherein each operating mode includes operating settings that are adapted to the prevailing type of rock, wherein said device includes at least one input device for selecting rock condition, whereby one or more of the following parameters varies as a function of the rock condition: feed pressure, percussion pressure, damping pressure, wherein said device includes at least one input device for inputting data related to bit size, whereby one or more of the following parameters are arranged to vary as a function of bit size: flushing flow, rotation speed, feed pressure, percussion pressure, ratio feed force-rotation torque relation, starting point for initiating anti-jam function, and wherein said device includes at least one input device for inputting data related to rod size, whereby one or more of the following parameters are arranged to vary as a function of rod size: percussion pressure, feed motor pressure, wherein activation of one operating mode is arranged also to set the parameter values for, activate or de-activate different drilling control functions, being one or more from the following group: boost, hole flushing, pressure control of feed, flow control of feed, anti-jam function, damping control function, super rotation, feed speed control of percussion pressure.

10. Device according to claim 9, wherein said operating parameters are a plurality from the group: feed motor pressure, rotation motor pressure, rotation speed, percussion pressure, percussion fluid flow, feed motor flow, rotation motor flow, flushing fluid flow, damping pressure control level.

11. Device according to claim 9, wherein when activating an operating mode values for drilling control functions of the rigs are arranged to be set.

12. Device according to claim 9, wherein said device operating modes are related to any from the group: soft rock, medium hard rock, hard rock, loose rock, abrasive rock, ore containing rock.

13. Device according to claim 9, wherein said device includes an input device for selecting any of the rock conditions from the group: soft rock, medium hard rock, hard rock, loose rock, abrasive rock, ore containing rock.

14. Device according to claim 9, wherein said device includes at least one input device for inputting data related to any one parameter from the group: bit size, rod size.

15. Device according to claim 9, wherein said device includes input means for inputting adjustments of operating parameter settings by an authorized operator.

16. Device according to claim 15, wherein said device includes means for recommending adjustments within predetermined ranges.

17. Device according to claim 15, wherein said device includes means for giving indications of recommended settings within recommended parameter ranges to the operator.

18. Device according to claim 16, wherein said device includes means for giving indications of recommended settings within recommended parameter ranges to the operator.

19. Drilling rig including a device according to claim 9.

* * * * *